US008746194B2

(12) United States Patent
Werler et al.

(10) Patent No.: US 8,746,194 B2
(45) **Date of Patent: *Jun. 10, 2014**

(54) VALVE TRAIN FOR INTERNAL COMBUSTION ENGINES FOR ACTUATING GAS EXCHANGE VALVES

(75) Inventors: Andreas Werler, Zwickau (DE); Thomas Arnold, Stollberg (DE); Heiko Neukirchner, Chemnitz (DE); Joerg Wutzler, Zwickau (DE)

(73) Assignee: Iav GmbH Ingenieurgesellschaft Auto und Verkehr, Berlin (DE)

( * ) Notice: Subject to any disclaimer, the term of this patent is extended or adjusted under 35 U.S.C. 154(b) by 137 days.

This patent is subject to a terminal disclaimer.

(21) Appl. No.: 13/388,062

(22) PCT Filed: Aug. 3, 2010

(86) PCT No.: PCT/DE2010/000931

§ 371 (c)(1), (2), (4) Date: Jan. 31, 2012

(87) PCT Pub. No.: WO2011/018074

PCT Pub. Date: Feb. 17, 2011

(65) Prior Publication Data

US 2012/0125274 A1 May 24, 2012

(30) Foreign Application Priority Data

Aug. 10, 2009 (DE) ..... 10 2009 037 270

(51) Int. Cl.
*F01L 1/34* (2006.01)

(52) U.S. Cl.
USPC ..... 123/90.18; 123/90.16

(58) Field of Classification Search
USPC ..... 123/90.16, 90.18, 90.6
See application file for complete search history.

(56) References Cited

U.S. PATENT DOCUMENTS

| | | | | |
|---|---|---|---|---|
| 3,481,314 | A | 12/1969 | LeCrenn | |
| 5,289,806 | A | 3/1994 | Hurr | |
| 5,509,384 | A | 4/1996 | Schmid | |
| 6,382,149 | B1 | 5/2002 | Fischer et al. | |
| 7,198,015 | B2 * | 4/2007 | Mobley | 123/90.18 |

(Continued)

FOREIGN PATENT DOCUMENTS

| | | | |
|---|---|---|---|
| DE | 3934848 | A1 | 4/1991 |
| DE | 4230877 | A1 | 4/1993 |

(Continued)

*Primary Examiner* — Thomas Denion
*Assistant Examiner* — Steven D Shipe
(74) *Attorney, Agent, or Firm* — Leydig, Voit & Mayer, Ltd.

(57) ABSTRACT

A valve train for actuating a gas exchange valve of an internal combustion engine includes a camshaft configured to be driven by a crankshaft of an engine and including a camshaft tube. At least one cam support including a plurality of cam profiles is disposed on the camshaft so as to be rotationally engaged and axially displaceable with respect to the camshaft. A switching shaft is disposed in the camshaft tube and is configured to rotate together with the camshaft tube. A dog operatively connects the at least one cam support to the switching shaft. A displacement piece is connected to the switching shaft and is configured to be rotationally engaged with and axially displaceable on the camshaft tube. The displacement piece is actuatable so as to rotate the switching shaft relative to the camshaft tube and displace the cam support relative to the camshaft tube using the dog.

9 Claims, 2 Drawing Sheets

(56) References Cited

U.S. PATENT DOCUMENTS

| | | | | |
|---|---|---|---|---|
| 8,230,833 | B2 * | 7/2012 | Werler et al. | 123/90.6 |
| 8,307,794 | B2 * | 11/2012 | Lengfeld et al. | 123/90.15 |
| 2004/0139936 | A1 * | 7/2004 | Mitchell | 123/90.16 |
| 2010/0242884 | A1 | 9/2010 | Meintschel et al. | |
| 2011/0226205 | A1 * | 9/2011 | Kraus | 123/90.18 |
| 2012/0037106 | A1 | 2/2012 | Werler et al. | |
| 2012/0125273 | A1 * | 5/2012 | Werler et al. | 123/90.6 |
| 2012/0138000 | A1 | 6/2012 | Schaedel et al. | |
| 2012/0138001 | A1 * | 6/2012 | Werler et al. | 123/90.18 |
| 2012/0227689 | A1 | 9/2012 | Bechtold | |
| 2013/0025554 | A1 * | 1/2013 | Werler et al. | 123/90.18 |

FOREIGN PATENT DOCUMENTS

| | | | |
|---|---|---|---|
| DE | 4331977 | A1 | 3/1995 |
| DE | 4416505 | A1 | 11/1995 |
| DE | 19520117 | A1 | 12/1996 |
| DE | 19825307 | A1 | 12/1999 |
| DE | 10054623 | A1 | 5/2002 |
| DE | 102007016977 | A1 | 10/2008 |
| DE | 102007027979 | A1 | 1/2009 |
| DE | 102007054978 | A1 | 5/2009 |
| DE | 102009037268 | B3 | 4/2011 |
| DE | 102009037269 | B4 | 6/2011 |
| DE | 102009017242 | B4 | 9/2011 |
| EP | 0579592 | A1 | 1/1994 |

* cited by examiner

VALVE TRAIN FOR INTERNAL COMBUSTION ENGINES FOR ACTUATING GAS EXCHANGE VALVES

CROSS-REFERENCE TO PRIOR APPLICATIONS

This application is a U.S. National Phase application under 35 U.S.C. §371 of International Application No. PCT/DE2010/000931, filed on Aug. 3, 2010, and claims benefit to German Patent Application No. DE 10 2009 037 270.9, filed on Aug. 10, 2009. The International Application was published in German on Feb. 17, 2011 as WO 2011/018074 under PCT Article 21(2).

FIELD

The invention relates to a valve train for internal combustion engines for actuating gas exchange valves.

BACKGROUND

Gas exchange valves of an internal combustion engine can be operated in a variable manner, with different opening and closing times and with different valve opening lifts. A valve control system of this type is previously described in DE 42 30 877 A1. In this document, a cam support having two different cam contours is arranged so as to be rotationally engaged but axially displaceable on a camshaft. Depending on the axial position of the cam support, one cam contour is operatively connected to the lift valve via an intermediate member (transmission lever). During the base circle phase, the cam support is axially displaced by means of a thrust collar, counter to the action of a pull-back spring, to change the valve parameters.

A drawback in this instance is the large amount of space required for adjusting the cam support. These solutions can therefore only be used with relatively large cylinder spacings, in such a way that the relevant components can be accommodated. A further drawback is the high inertial forces during the adjustment process which are required for displacing the cam support or the adjustment members. It is only possible to switch to a corresponding cam contour in a cylinder-selective manner. Valve-selective switching is not possible.

DE 100 54 623 A1 describes a device for switching a cam support on a camshaft for actuating gas exchange valves, in which the cam support is guided in axial displacement on the camshaft. The gas exchange valve is operatively connected to different cam contours depending on the position of the cam support. The cam support is adjusted via an adjustment element in cooperation with a slide path. In this instance the adjustment element is a radially outwardly displaceable pin, which when extended cooperates with at least two slide paths formed in a guide part arranged through approximately 180° around the cam support.

A drawback of this solution, in addition to the additional space for the guide part, is that to switch to a different cam contour, the pin has to be extended from the camshaft and slid into an axially displaceable switch slide. After the switching process, the pin has to be retracted again. This construction has high parts and manufacturing requirements, and there is a risk of damage to the camshaft as a result of incorrect switching of the pin. A further drawback is that the necessary adjustment time of the pin restricts the rotational speed of the motor. In addition, the adjustment is dependent on the oil pressure provided in each case.

Further, a valve train of an internal combustion engine is described in DE 195 20 117 C2, in which an axially displaceable cam support having at least two different cam paths is arranged rotationally engaged on the camshaft. The cam support is adjusted by means of an adjustment member, which is guided inside the camshaft. A double-action hydraulic or pneumatic piston cylinder unit, arranged on an end face of the camshaft, displaces the undulating adjustment member inside the camshaft counter to the compression of a spring. The adjustment member is connected to an entrainment piece, which penetrates through a slot arranged axially in the camshaft and extends into a hole in the cam support.

The drawback of this solution is that by axially displacing the adjustment member, it is only possible to displace a plurality of cam supports arranged on the camshaft simultaneously. Different switching of individual cam supports on a camshaft is not possible. A further drawback is that in a switching position in which an external cam is engaged in the gas exchange valve, the spring element is constantly under tension. This results in high lateral frictional forces between the entrainment piece and the guide path arranged on the adjustment member. This leads to increased wear and possible related incorrect switchings. A further drawback is that the acting spring forces have to be adjusted precisely so as to prevent incorrect switchings, in particular when switching back to the central cam profile if there are three different cam profiles.

DE 10 2009 017 242, held by the Applicant, describes a valve train for actuating gas exchange valves of internal combustion engines. In the valve train, the cam support is displaced on the camshaft tube, for valve switching, by a switching shaft rotatably arranged inside the camshaft tube. The switching shaft is provided with a switching contour having an axial inclination. A switching ball, which is mounted in a hole of an axially displaceable switching sleeve which encircles the switching shaft, is guided in the switching contour. The switching sleeve is operatively connected to the cam support via a dog. When the switching shaft is rotated, the switching sleeve is axially displaced via the switching ball and the cam support is axially displaced via the dog.

The arrangement of a switching sleeve between the switching shaft and the camshaft tube leads to frictional forces which additionally have to be overcome. Moreover, the solution by way of the switching sleeve arrangement has high parts requirements.

SUMMARY

In an embodiment, the present invention provides a valve train for actuating a gas exchange valve of an internal combustion engine. At least one camshaft is configured to be driven by a crankshaft of the internal combustion engine and includes a camshaft tube. At least one cam support is disposed on the at least one camshaft so as to be rotationally engaged and axially displaceable with respect to the at least one camshaft, the at least one cam support including an identical base circle portion and a plurality of cam profiles differing from one another. A switching shaft is disposed in the camshaft tube and is configured to rotate together with the camshaft tube. A dog operatively connects the at least one cam support to the switching shaft. A displacement piece is connected to the switching shaft and is configured to be rotationally engaged with and axially displaceable on the camshaft tube. An actuator is connected operatively to the displacement piece by the dog. The dog is configured to slide in a switching contour of the switching shaft so as to rotate the switching shaft relative to the camshaft tube and the at least one cam support and axially displace the at least one cam support.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

An embodiment of the invention provides a valve train for actuating gas exchange valves of internal combustion engines which is distinguished by a simplified construction together with a reduction in the frictional forces.

In an embodiment, the valve train for actuating the gas exchange valves consists of a tubular camshaft which is driven by a crankshaft of the internal combustion engine. One or more rotationally engaged but axially displaceable cam supports are arranged on the camshaft tube, and each have an identical base circle portion having a plurality of different cam profiles. By displacing the cam supports, the cam profiles can be operatively connected to the gas exchange valves. According to the invention, the cam support is displaced on the camshaft tube, for valve switching, by a switching shaft, which is arranged inside the camshaft tube, rotates together with the camshaft tube, and is operatively connected to a cam support, which is axially displaceable on the camshaft tube, via a dog, which slides in a switching contour on the switching shaft. The switching shaft is connected via a transmission to a displacement piece, which is rotationally engaged but axially displaceable on the cam sleeve and for actuating the switching shaft can be operatively connected to an actuator to rotate the switching shaft relative to the camshaft tube.

In an embodiment, an advantage of the solution according to the invention is a simple construction of the actuation device for reliably switching valves between different cam profiles of the camshaft, in which the friction between the individual components is also reduced.

Further advantageous configurations are disclosed in the dependent claims, and explained in the description together with the effects thereof.

Figure 1:
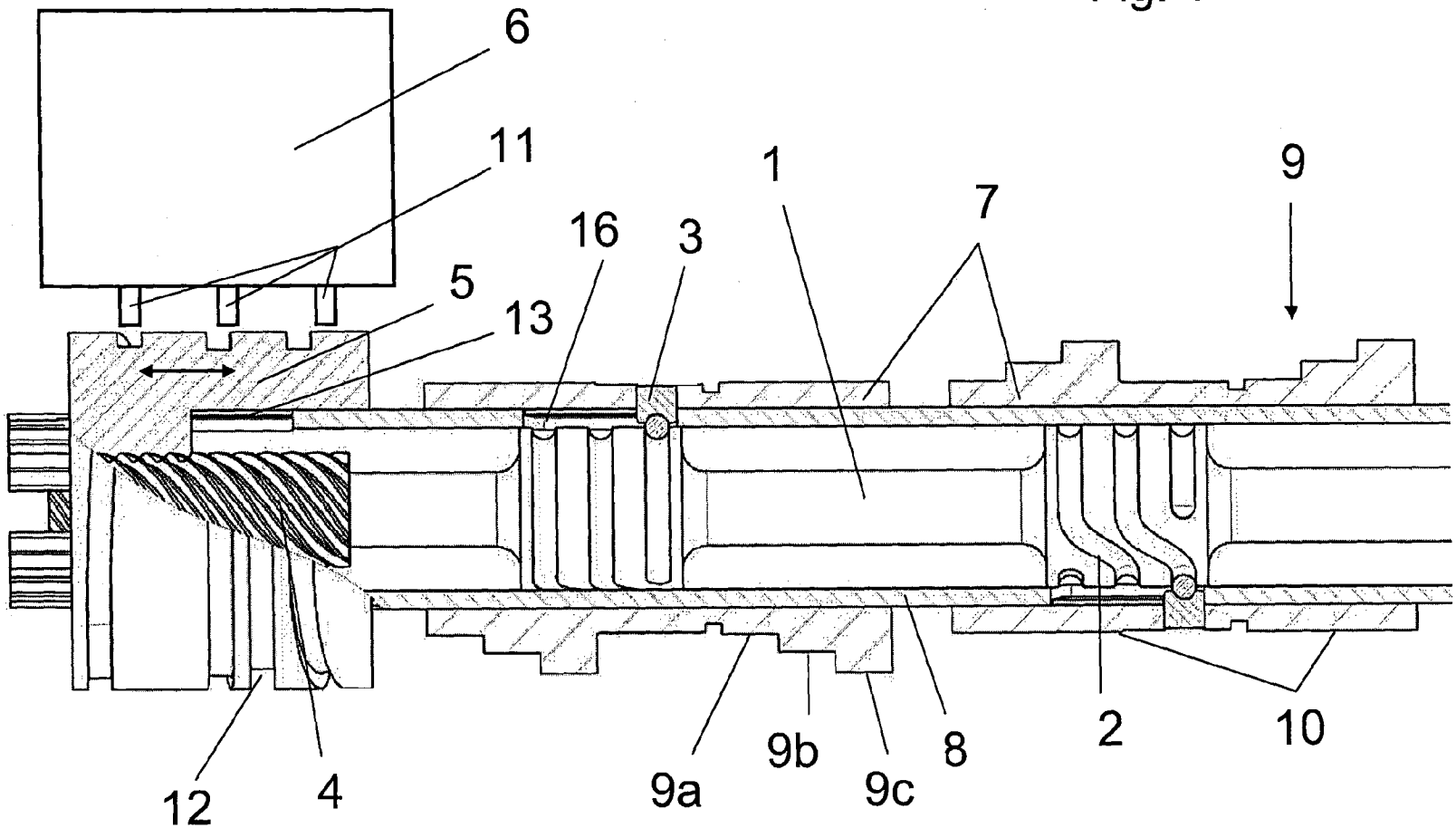
FIG. 1 is a sectional view of the solution according to an embodiment of the invention.

FIG. 1 is a section of a sub-region of a valve train of an internal combustion engine. The valve train for actuating gas exchange valves consists of a camshaft, which is driven by a crankshaft of the internal combustion machine and is in the form of a camshaft tube 8. A plurality of cam supports 7 are arranged on the camshaft tube 8 so as to be rotationally engaged but axially displaceable. An axially displaceable cam support 7 is associated with each cylinder of a multi-cylinder internal combustion engine, and according to the embodiment, two gas exchange valves of a cylinder can be actuated by each cam support 7 by way of the two cam profiles 9 arranged thereon. The cam support 7 has a plurality of different cam profiles 9*a*, 9*b* and 9*c* having an identical base circle portion 10, which for valve lift switching are each selectively brought into contact with a respective gas exchange valve, directly or via intermediate members, by displacing the cam support 7. In the embodiment shown, the cam support 7 has three different cam profiles, a large cam profile 9*c*, a medium cam profile 9*b* and a small cam profile 9*a*. It is perfectly conceivable for the cam support 7 to have only two or more than three different cam profiles 9. To achieve a phase shift between the different cam profiles 9*a*, 9*b* and 9*c*, the curves of the cam profiles 9*a*, 9*b* and 9*c* may be arranged mutually offset.

A switching shaft 1 is arranged inside the camshaft tube 8, and apart from during the switching process rotates synchronously with the camshaft tube 8 and the axially displaceable cam supports 7 located thereon. For axially displacing the cam support 7, and thus for switching between the individual cam profiles 9*a*, 9*b* and 9*c*, the cam support 7 is operatively connected to the switching shaft 1 via at least one dog 3. So as to be able to carry out the respective switching processes by axially displacing the cam support 7, one opening 16 is arranged in the camshaft tube 8 for each dog 3. The width of the opening 16 corresponds to at least the maximum axial displacement of the cam support 7.

The dog 3 is rigidly connected to the cam support 7 and is also slidingly mounted in an encircling switching contour 2 arranged on the surface of the switching shaft 1. The rigid connection of the dog 3 to the cam support 7 and the lateral guidance of the dog 3 in the opening 16 in the camshaft tube 8 provide the rotationally engaged but axially displaceable mounting of the cam support 7 on the camshaft tube 8. At the same time, the dog 3 provides the torque transmission from the camshaft tube 8 to the cam supports 7.

The switching contour 2 arranged on the surface of the switching shaft 1 for each cam support 7 is provided with an axial inclination. The axial inclination results in a spiral switching contour 2 on the surface of the switching shaft 1, the starts of the respective switching contours on the switching shaft 1 being arranged identically or mutually offset on the circumference, depending on the axial displacements to be carried out by the individual cam supports 7. If the individual cam supports 7 are to be axially displaced in succession, the individual axial inclinations of the switching contours 2 arranged for the respective cam supports 7 are arranged mutually offset on the circumference of the switching shaft 1. This variant is shown in FIG. 1. If the individual cam supports 7 are to be axially displaced simultaneously, the individual axial inclinations of the switching contours 2 arranged for the respective cam supports 7 are positioned in the same axial plane on the circumference of the switching shaft 1.

According to FIG. 1, the switching shaft 1 is connected via a threaded shaft 4 to a displacement piece 5, which is rotationally engaged but axially displaceable on the camshaft tube 8. In this instance the camshaft tube 8 and the displacement piece 5 are connected via meshing axial toothing 13. The threaded shaft 4 of the switching shaft 1 is in the form of oblique toothing and engages in the matching toothing of the displacement piece 5. The displacement piece 5 can be operatively connected to an actuator 6 which is rigidly connected to a housing of the internal combustion engine. Thus, when the actuator 6 is actuated, a pin 11 arranged on the actuator 6 engages in the contour 12 arranged on the circumference of the displacement piece 5. The displacement piece 5 is axially displaceable on the camshaft tube 8 in both directions, as shown by the double-headed arrow in the drawings.

Figure 2:
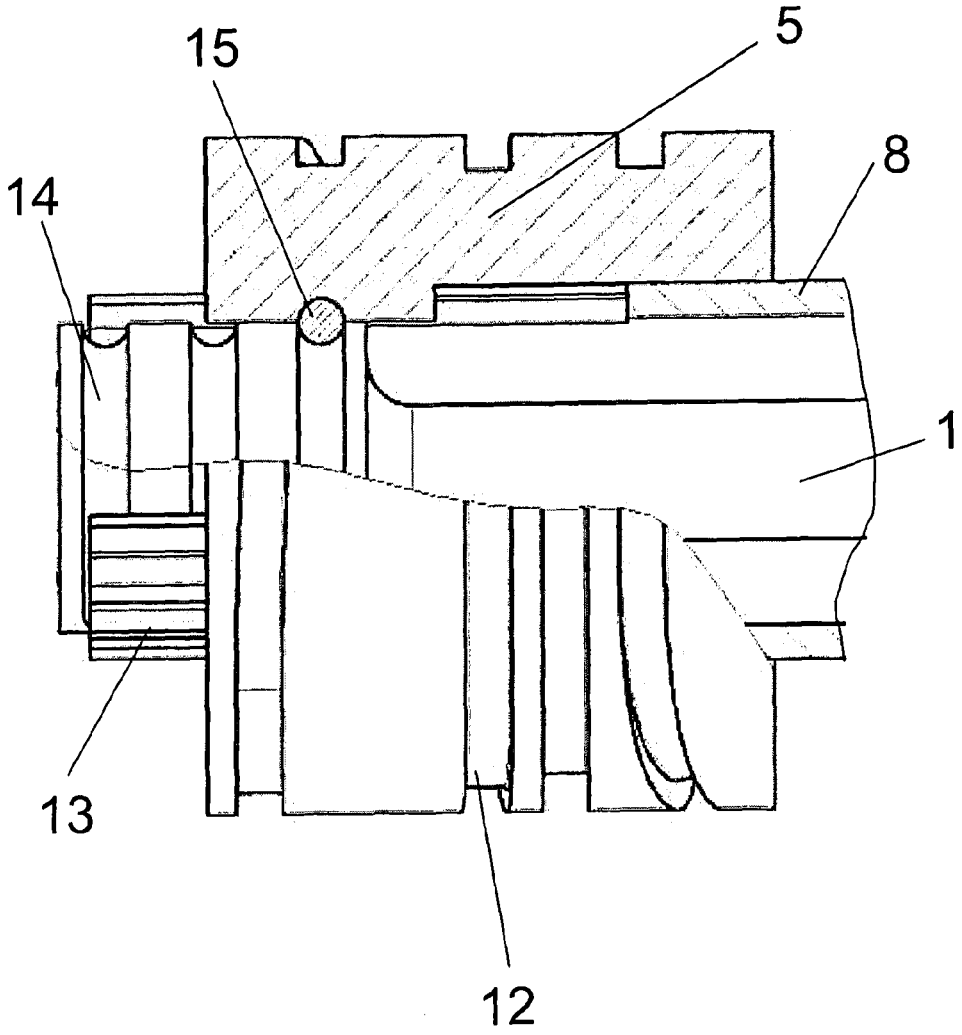
FIG. 2 is a half sectional view of a detail of another embodiment of the invention.

FIG. 2 shows a variant of the connection of the switching shaft 1 to the displacement piece 5 which is axially displaceable on the camshaft tube 8. In this case the switching shaft 1 is connected to the displacement piece 5 via a cam mechanism. The cam mechanism consists of a switching contour 14 arranged on the circumference of the switching shaft 1, a switching hall 15 being mounted in said switching shaft and in turn being mounted in a hemispherical recess arranged on the inner circumference of the displacement piece 5. The displacement piece 5 is also displaced by an actuator 6.

The variable valve drive operates as follows to provide switching between the different cam profiles 9*a*, 9*b* and 9*c*.

While the central cam profile 9*b* of the cam support 7 is engaged with the gas exchange valve, for example, the camshaft tube 8, the cam support 7, the switching shaft 1 and the displacement piece 5 rotate at a synchronous rotational speed. The actuator 6 is not engaged with the displacement piece 5. It is only possible to switch to another cam profile when the base circle portion 10 is engaged with the gas exchange valve or the intermediate member. To switch the engagement of the cam profile 9*b* on the gas exchange valve to the cam profile 9*a* or the cam profile 9*c*, the actuator 6 is activated by an appropriate actuation and brought into engagement with the displacement piece 5. In the disclosed embodiment, this is provided in that a pin 11 is extended towards the displacement piece 5 and latches into the contour 12 arranged on the circumference of the displacement piece 5. Depending on the actuated pin 11, the displacement piece 5 is axially displaced to the right or to the left on the camshaft 8, in accordance with the switching process to be carried out, by the pin 11, which slides in the contour 12. The axial movement of the displacement piece 5 is transformed into a rotation of the switching shaft 1 via the threaded shaft 4 according to FIG. 1 or via the cam transmission according to FIG. 2. This results in rotation of the switching shaft 1 relative to the camshaft tube 8 and the cam supports 7. The relative rotation causes the hemispherical part of the dog 3 to slide in the path of the switching contour 2. Based on the relative rotation and the individual switching contours 2 which are operatively connected to each cam support 7 via the dogs 3, the cam supports 7 are axially displaced relative to one another, resulting in switching between the individual cam profiles 9*a*, 9*b* and 9*c*.

The displacement piece 5 may also for example be displaced by an actuator which acts magnetically on the displacement piece 5.

An advantage of the solution according to the invention is a small, simple construction of the valve train, with which valve switchings variably adapted to the motor are possible.

While the invention has been described with reference to particular embodiments thereof, it will be understood by those having ordinary skill the art that various changes may be made therein without departing from the scope and spirit of the invention. Further, the present invention is not limited to the embodiments described herein; reference should be had to the appended claims.

LIST OF REFERENCE NUMERALS

1 switching shaft
2 switching contour
3 dog
4 threaded shaft
5 displacement piece
6 actuator
7 cam support
8 camshaft tube
9 cam profile
9*a* small cam profile
9*b* medium cam profile
9*c* large cam profile
10 base circle portion
11 pin
12 contour
13 axial toothing
14 switching contour
15 switching ball
16 opening

The invention claimed is:

1. A valve train for actuating a plurality of gas exchange valves of an internal combustion engine, the valve train comprising:

at least one camshaft configured to be driven by a crankshaft of the internal combustion engine and including a camshaft tube;

at least one cam support disposed on the at least one camshaft so as to be rotationally engaged and axially displaceable with respect to the at least one camshaft, the at least one cam support including a plurality of different cam profiles having an identical base circle portion;

a switching shaft disposed in the camshaft tube and configured to rotate together with the camshaft tube;

a dog operatively connecting the at least one cam support to the switching shaft, the dog being configured to slide in a switching contour of the switching shaft;

a displacement piece connected to the switching shaft and configured to be rotationally engaged with and axially displaceable on the camshaft tube; and an actuator operatively connected to the displacement piece and configured to actuate the displacement piece so as to rotate the switching shaft relative to the camshaft tube, wherein when the switching shaft is rotated relative to the camshaft tube the dog axially displaces the at least one cam support relative to the camshaft.

2. The valve train as recited in claim 1, wherein the actuator is rigidly connected to a housing of the internal combustion engine.

3. The valve train as recited in claim 1, wherein the switching contour includes an axial inclination.

4. The valve train as recited in claim 1, wherein the at least one cam support includes a plurality of cam supports, and wherein each one of the plurality of cam supports is operatively connected to a respective switching contour via a respective dog, the respective dog being rigidly connected to each one of the plurality of cam supports.

5. The valve train as recited in claim 4, wherein the plurality of cam supports are configured to be axially displaced in succession, and wherein the respective switching contours each include an axial inclination, the axial inclinations of the respective switching contours being mutually offset with respect to each other on a circumference of the switching shaft.

6. The valve train as recited in claim 4, wherein the plurality of cam supports are configured to be axially displaced simultaneously, and wherein the respective switching contours each include an axial inclination, the axial inclinations of the respective switching contours being disposed in a same axial plane on a circumference of the switching shaft.

7. The valve train as recited in claim 1, thither comprising a threaded shaft connecting the switching shaft to the displacement piece.

8. The valve train as recited in claim 7, wherein the threaded shaft includes an oblique toothing which forms the connection between the switching shaft and the displacement piece.

9. The valve train as recited in claim 1, further comprising a cam transmission connecting the switching shaft to the displacement piece.

* * * * *